US005361698A

United States Patent [19]

Simeth

[11] Patent Number: 5,361,698

[45] Date of Patent: Nov. 8, 1994

[54] DEVICE FOR CLAMPING A PRINTING PLATE ONTO A PLATE CYLINDER

[75] Inventor: Claus Simeth, Geisenheim, Germany

[73] Assignee: MAN Roland Druckmaschinen AG, Germany

[21] Appl. No.: 20,634

[22] Filed: Feb. 22, 1993

[30] Foreign Application Priority Data

Feb. 21, 1992 [DE] Germany ..... 4205276

[51] Int. Cl.[5] ..... B41F 1/28

[52] U.S. Cl. ..... 101/415.1; 101/383

[58] Field of Search ..... 101/415.1, DIG. 36, 101/384, 383, 382.1

[56] References Cited

U.S. PATENT DOCUMENTS

| | | | |
|---|---|---|---|
| 3,025,790 | 3/1962 | Larsen | 101/451.1 |
| 3,151,554 | 10/1964 | Townsend | 101/415.1 |
| 3,188,952 | 6/1965 | Miller | 101/415.1 |
| 4,006,686 | 2/1977 | Ackerman | 101/415.1 |
| 5,088,408 | 2/1992 | Philpot | 101/415.1 |

FOREIGN PATENT DOCUMENTS

| | | | |
|---|---|---|---|
| 0269816 | 6/1988 | European Pat. Off. | 101/DIG. 36 |
| 7216860 | 4/1972 | Germany . | |
| 232730A2 | 8/1987 | Germany . | |
| 426022 | 5/1991 | Germany . | |
| 3933678C2 | 8/1991 | Germany . | |
| 0057261 | 8/1945 | Netherlands | 101/415.1 |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

An apparatus for clamping a flexible printing plate onto a plate cylinder including an adjustable front clamping strip for releasably engaging a leading end of the printing plate and a plurality of axially spaced pins which engage respective axially spaced holes in the rear of the printing plate. The printing plate is held on the circumference of the printing cylinder with relative little force so that any inaccuracies can be easily corrected through adjustment of the front clamping strip.

10 Claims, 2 Drawing Sheets

DEVICE FOR CLAMPING A PRINTING PLATE ONTO A PLATE CYLINDER

FIELD OF THE INVENTION

The invention relates to a device for clamping a flexible printing plate onto a plate cylinder of a rotary printing machine, and more particularly, to a printing plate clamping arrangement for releasably engaging the leading and trailing ends of the plate and which includes means for tensioning the printing plate about the cylinder surface.

BACKGROUND OF THE INVENTION

Printing plate clamping devices of such type are known, such as shown in EP 0,232,730 A2, EP 0,426,022 A2 and DE 3,933,678 C2 to applicant. A feature common to these known clamping devices is that the printing plate is clamped onto the plate cylinder by means of respective front and rear clamping rails or strips. At least one and preferably both of the clamping strips are adjustable at least in the circumferential direction, and spring means act on the clamping strips to tension the printing plate on the cylinder surface.

Although the above-mentioned clamping devices of applicant have proved successful, the printing plate is clamped on the plate cylinder with relatively high force as a result of spring elements acting on both the front and rear clamping strips, and this sometimes can be disadvantageous. Since modern printing plates are made of relatively thin material, usually aluminum, if subjected to excessive stress, they will experience inadmissible deformation, or even tear. Reinforcement of the leading and trailing edges of the printing plate which are engaged by the clamping strips does not remedy the problem because the surface of the printing plate is still thin and therefore sensitive.

Prior clamping devices have a further disadvantage in that when a register correction is made, the register error can only be rectified locally, while the error may persist at other points on the printing plate because the plate cannot be entirely shifted during the registration correction. Moreover, because of the relatively high tensile forces exerted on the printing plate, relatively high frictional forces exist between the printing plate and the cylinder surface, and therefore, during a registration correction on one of the clamping strips, the correction does not carry over the entire surface of the printing plate without further action, as might otherwise occur with a rigid or stiff material. Finally, a further disadvantage of prior clamping devices is that they require a large amount of space and have a high weight, caused, in particular, by the requirement of two separate clamping strips. When the printing machine is in operation, this weight can result in an imbalance which, in turn, must be compensated for by suitable means.

OBJECTS AND SUMMARY OF THE INVENTION

It is an object of the present invention to provide a device for clamping a flexible printing plate onto a plate cylinder of a rotary printing machine in a manner which permits register corrections to be more easily and accurately effected.

Another object is to provide a clamping device as characterized above which will not distort or damage the printing plate or the printing plate image.

A further object is to provide a clamping device of the above kind which is relatively simple and compact in construction and which lends itself to economical manufacture and reliable use.

To achieve the foregoing objects, the invention is characterized in that there is provided in the cylinder pit a plurality of axially spaced spring elements which can be releasably fastened to the rear edge of the printing plate and which are resilient in both the circumferential and axial directions of the cylinder. While a conventional clamping rail or strip may be employed to clamp the leading or front end of the plate, such conventional clamping rails may be eliminated at the rear end of the plate. Instead, the plurality of spring elements according to the present invention ensure that the printing plate remains tensioned and does not wobble or flap during operation, as would occur if tensioning means were eliminated completely. Because the spring elements are resilient in both the circumferential and axial directions, the printing plate is pulled flat at its rear end by means of the spring elements. It is important, at the same time, that this action in pulling the printing plate flat takes place automatically during operation of the printing machine after a few revolutions of the plate cylinder, because the plate cylinder together with the clamped printing plate rolls on a back-up cylinder, specifically, starting from the front clamping strip and proceeding in the rearward direction. The spring elements of the present invention directly follow the changes in plate length which possibly occur, and the printing plate is thereby smoothed flat on the cylinder surface. All this takes place, without excessively high forces acting on the printing plate.

A register correction also can be made, and for this purpose the front clamping strip is adjustable in a conventional manner, specifically, at least in the circumferential direction and preferably also in the axial direction, or also in directions forming an angle therewith in the plane for the plate cylinder at its print start. Clamping strips having such adjustment capabilities are well known in the art, one of which is disclosed, for example, in the previously mentioned EP 0, 426,022, in particular FIGS. 6 to 8 and associated description, the disclosure of which is incorporated herein by reference.

The spring elements of the present invention may take various design forms. According to a preferred embodiment, the spring elements are in the form of pins which engage in corresponding holes at the rear edge of the printing plate. This is preferred particularly because pins of this type can in a simple way be made elastically resilient in the requisite directions in the plane of the rear end of the printing plate, and also, the fastening of the pins to the printing plate by means of said holes is simple. Alternatively, the spring elements could be clamped or otherwise releasably fastened to the rear end of the printing plate.

Fastening of the rear end of the printing plate is particularly simple if the pins are formed with respective receptacles or notches at their upper ends for receiving and captively retaining the printing plate. The rear of the printing plate, in the relieved state, need only to be positioned over the pins in such a way that the pins pass through the holes, with the printing plate engaging the receptacles or notches of the pins.

The requisite elasticity of the spring elements of the present invention also can be achieved in a simple way if the spring elements are designed as pins, the feet of which may be embedded in holders made of elastic material. The elastic material may, for example, be a plastic of suitable elasticity, or alternatively, a rubber material.

Other objects and advantages of the invention will become apparent upon reading the following detailed description and upon reference to the drawings, in which:

Figure 1:
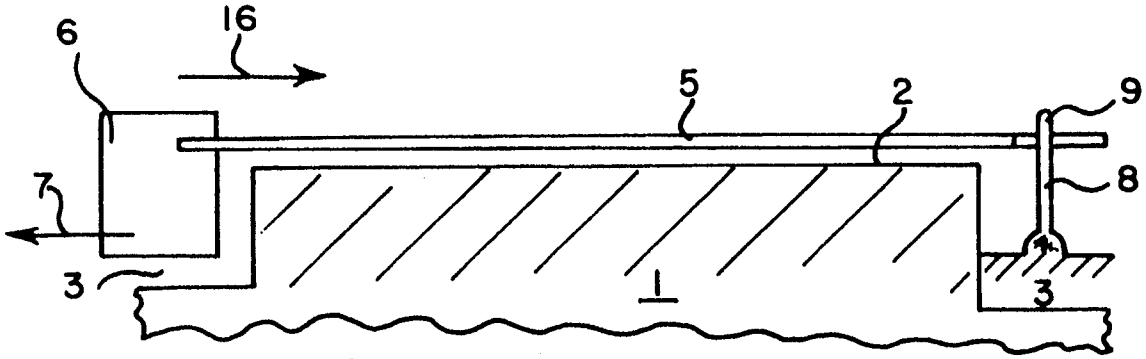
FIG. 1 is a diagrammatic side view of a printing cylinder having a printing plate clamping device according to the present invention, with the cylindrical surface of the plate cylinder shown in a straight plane for the sake of simplicity.

Referring now more particularly to FIG. 1 of the drawings, there is diagrammatically shown a printing machine cylinder 1 having a plate clamping device according to the present invention for securing a printing plate 5 during a printing operation. For the sake of simplicity, the plate cylinder 1 has its actual cylindrical surface shown in straight fashion, with the printing plate being shown in exploded or spaced relation to the cylindrical surface 2. The plate cylinder 1 is formed with a single pit 3, which again for purposes of illustration, is shown in FIG. 1 at left and right-hand sides of the plate cylindrical surface 2. The plate cylinder 1 rotates in the direction of the arrow 4, and hence, the left-hand end of the printing plate 5, as shown in FIG. 1, is the leading or front end.

The front end of the printing plate 5 is clamped in a front clamping strip 6 disposed within the cylinder pit 3, which thus determines the print start. The clamping strip 6 may be of a conventional type, displaceable in the direction of the arrow 7, for purposes of tensioning the plate about the cylinder. To relieve such tension, the clamping strip can be displaced adjustably in the opposite direction, again in a known manner. The clamping strip 6 preferably not only is adjustably displaceable circumferentially in the direction of the arrow 7, but also in an axial direction and in a tilting direction, as known in the art.

Figure 2:
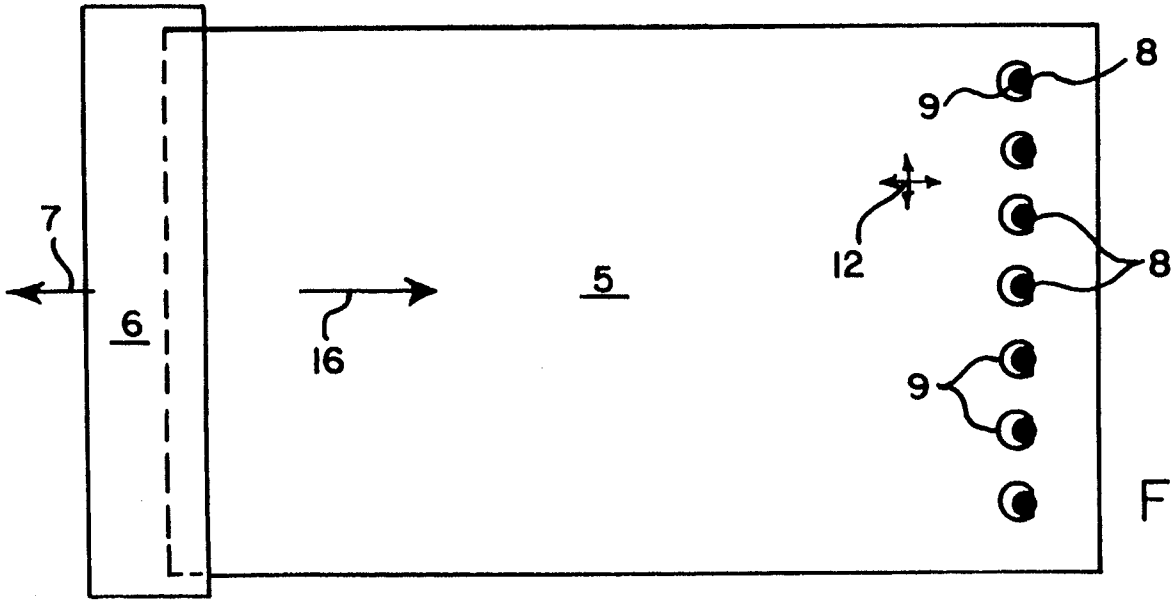
FIG. 2 is a top view of the plate cylinder and clamping device shown in FIG. 1.
Figure 3:
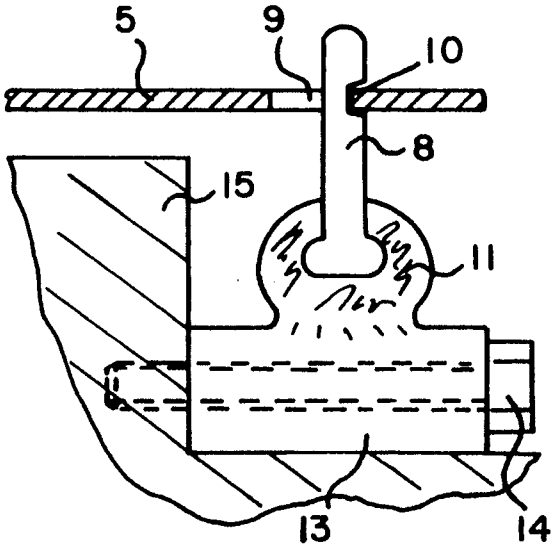
FIG. 3 is an enlarged elevational view of one of the spring elements engaging a trailing or rear end of the printing plate
Figure 4:
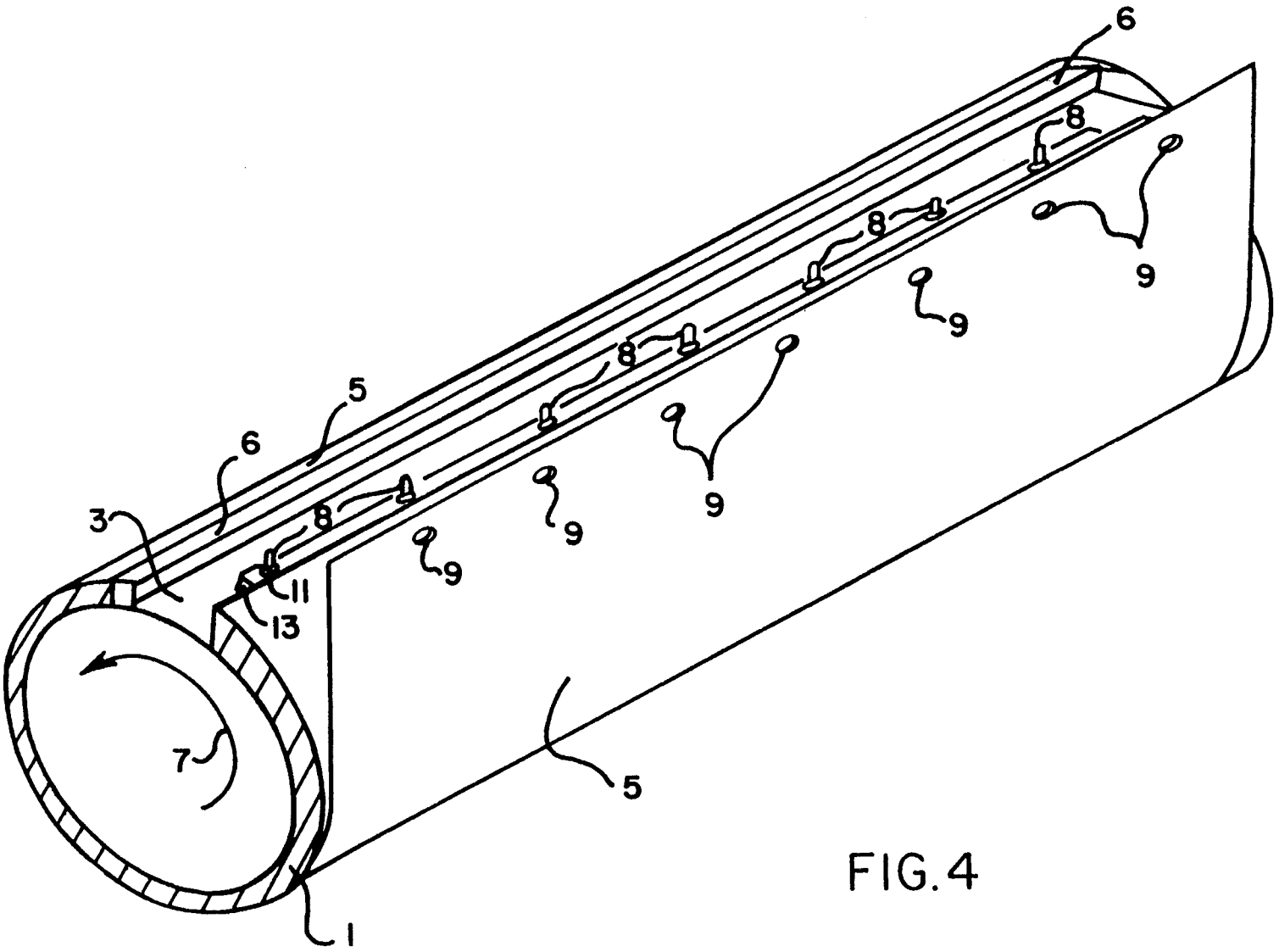
FIG. 4 is a perspective view of a plate cylinder and flexible plate having a plate clamping device according to the invention; and While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

In accordance with the invention, the rear of the printing plate is releasably engageable by a plurality of axially spaced spring elements which are resilient in both circumferential and axial directions with respect to the cylinder. To this end, in the illustrated embodiment, a plurality of axially spaced elastically resilient pins 8 are provided in the cylinder pit 3 adjacent the trailing or rear end of the printing plate 5 for releasable engagement within corresponding holes 9 in the rear of the printing plate. The pins 8 in this case each have an enlarged foot 8*a* retained within a casted holder 11 made of elastomeric material, such as plastic or rubber, so that the pins are moveable in the manner of a ball joint, but with limited deflection, with their outer printing plate engaging ends in being moveable in circumferential and axial directions within the sector of a circle, as indicated in FIG. 2 by the arrows 12 perpendicular to one another.

The pin holder 11 in this instance has an integrally formed foot 13 which may be secured to a radial wall 15 of the pit 3 by means of a screw 14 that is threadably engageable with an aperture in the wall 15. A single foot 13 may be utilized for supporting all of the plurality of pins 8.

In keeping with the invention, the upper ends of the pin 8 each are formed with a respective receptacle or notch 10 into which the rear edges defined by the holes 9 in the printing plate are inserted. The receptacles or notches 10 serve to captively retain the end of the printing plate 5 in mounted position during operation of the printing cylinder. The holes 9 preferably are larger than the cross sections of the pins 8 so that the pins can be easily slipped into the holes during mounting of the plate 5 onto the plate cylinder 1. The spacing of the pins 8 may be on the order of a few centimeters, for example, approximately 3 to 5 centimeters, so that elastic force influence of the pins is operable virtually over the entire rear surface of the printing plate 5.

Although for purposes of illustration in the drawings, parts of the clamping strips 6 and the pins 8 are shown projecting above the cylinder surface 2, in actuality, these components are arranged within the cylinder pit so that they do not cause any disturbance during the printing operation. For this purpose, the printing plate 5 is positioned onto the cylinder surface 2 with the front and rear ends bent around the respective edges of the cylinder pit, as is known in the art.

With the printing plate 5 properly mounted between the clamping strip 6 and the resilient pins 8, the printing machine may be set in operation, with the plate cylinder acting upon a back up cylinder in a known manner, rolling on the cylinder surface or on the printing plate in the direction of the arrow 16. Any unevenness possibly present in the surface of the printing plate 5 is thereby smoothed out in a flat manner. The flat state of the printing plate, once obtained, is preserved, according to the invention, due to the spring pins 8 resilient engagement with the rear end of the printing plate. If appropriate, the register of the plate can be corrected once again by an appropriate adjustment of the clamping strip 6.

From the foregoing, it will also be appreciated by one skilled in the art that the resilient spring elements of the present invention permit support of the printing plate without distortion or damage, while facilitating easier, accurate plate register corrections. The clamping device also is relatively simple and compact in construction, and lends itself to economical manufacture and reliable use.

What is claimed is:

1. An apparatus for clamping a flexible printing plate having leading and rear ends onto a plate cylinder of a rotary printing press having a recessed pit formed within the cylinder comprising front end clamping means disposed in said pit for engaging the leading end of the printing plate, rear end engaging means for releasably engaging the rear end of said printing plate, said rear end engaging means including a plurality of axially spaced resilient spring elements each being engageable with the rear end of the printing plate and being resiliently deflectable in circumferential and axial directions with respect to the printing cylinder.

2. The apparatus of claim 1 in which said spring elements are pins which engage in corresponding holes formed in a rear end of the printing plate.

3. The apparatus of claim 2 in which said pins have their upper ends formed with receptacles for captively retaining a printing plate engaged therewith.

4. The apparatus of claim 1 in which said spring elements are pins having feet embedded in holders made of elastic material.

5. The apparatus of claim 4 including means for securing said holders to said printing cylinder within said pit.

6. The apparatus of claim 5 in which a single holder supports a plurality of said pins.

7. A plate cylinder assembly for a rotary printing press comprising a rotary plate cylinder formed with a pit, a printing plate having a leading end and a rear end positioned onto said cylinder, front end clamping means disposed in said pit for engaging the leading end of the printing plate, rear end engaging means for releasably engaging a rear end of said printing plate, and said rear end engaging means including a plurality of axially spaced resilient spring elements each being engageable with a rear end of the printing plate and being resiliently deflectable in circumferential and axial directions with respect to the printing cylinder.

8. The assembly of claim 7 in which a rear end of said printing plate is formed with a plurality of axially spaced holes, and said spring elements are pins which each engage in a corresponding one of said printing plate holes.

9. The assembly of claim 8 in which said pins each have a foot embedded in a holder made of elastomeric material, and means for securing said holder to said cylinder within said pit.

10. An apparatus for clamping a flexible printing plate having leading and rear ends onto a plate cylinder of a rotary printing press having a recessed pit formed the cylinder comprising front end clamping means disposed in said pit for engaging the leading end of the printing plate, rear end engaging means for releasably engaging the rear end of said printing plate, said rear end engaging means including at least one support below the surface level of the cylinder and further including a plurality of axially spaced spring elements extending from the support, each spring element having a receptacle nearer a distal end of the spring element than to the support and being captively engageable with the rear end of the printing plate and being resiliently deflectable in circumferential and axial directions with respect to the printing cylinder.

* * * * *